US006214167B1

(12) United States Patent
Halmschlager et al.

(10) Patent No.: US 6,214,167 B1
(45) Date of Patent: Apr. 10, 2001

(54) TWIN-WIRE FORMER AND PROCESS FOR SEPARATING UPPER AND LOWER WIRES OF HTE TWIN-WIRE FORMER

(75) Inventors: Günter Halmschlager, Krems; Franz Stelzhammer, Böheimkirchen; Alexander Wassermann, Wien, all of (AT); Jürgen Banning, Düren (DE); Werner Leitenberger, Schlier (DE); Thomas Elenz, Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/263,108

(22) Filed: Mar. 5, 1999

(30) Foreign Application Priority Data

Mar. 6, 1998 (DE) ..... 198 09 480

(51) Int. Cl.[7] ..... D21F 9/02

(52) U.S. Cl. ..... 162/199; 162/272; 162/300; 162/301

(58) Field of Search ..... 162/203, 199, 162/200, 272, 273, 300, 301

(56) References Cited

U.S. PATENT DOCUMENTS

| | | | | |
|---|---|---|---|---|
| 3,994,774 | * | 11/1976 | Halme et al. | 162/301 |
| 4,146,424 | * | 3/1979 | Justus | 162/301 |
| 4,724,047 | | 2/1988 | Creagan et al. | 162/300 |

(List continued on next page.)

FOREIGN PATENT DOCUMENTS

| | | |
|---|---|---|
| 382655 | 3/1987 | (AT) . |
| 4005420 | 8/1991 | (DE) . |
| 4326867 | 12/1993 | (DE) . |
| 0397430 | 11/1990 | (EP) . |

*Primary Examiner*—Karen M. Hastings
(74) *Attorney, Agent, or Firm*—Greenblum & Bernstein, P.L.C.

(57) ABSTRACT

Twin-wire former for producing a fibrous material web from a fibrous suspension and process for separating upper and lower wires of the twin-wire former. The twin-wire former includes a twin-wire zone composed of a lower wire and an upper wire and a plurality of rolls including an inlet roll and an outlet roll. The upper wire is guidable over the plurality of rolls, the inlet roll guides the upper wire to the twin-wire zone, and the outlet roll guides the upper wire toward the inlet roll. A wedge-shaped inlet zone is formed between the upper wire and the lower wire and has an adjustable inlet wedge angle. An upper wire subassembly includes a drainage box adapted to receive suspension water that flows upwardly through the upper wire, and further includes a pivotable common support device, to which the drainage box and the inlet roll are mounted. A stroke device is coupled to the pivotable common support device to lift the pivotable common support device around a first horizontal axle. In this manner, the inlet wedge angle is varied during former operation. After a maximal inlet wedge angle is formed, continued lifting of the pivotable common support device by the stroke device causes the upper wire subassembly to lift up from the lower wire, thereby separating the upper wire from the lower wire. A second horizontal pivot axle associated with the upper wire subassembly and located in a region of the outlet roll is provided. The separating of the upper and lower wires occurs around the second horizontal pivot axle. The process includes lifting the common support device with the stroke device, such that the common support device is pivotably supported by the first horizontal axle and the inlet wedge angle is increased, and, upon maximally increasing the inlet wedge angle, further lifting the common support device with the stroke device, such that the common support device is pivotably supported by the second horizontal axle and is disengaged from the first horizontal axle. In this manner, the upper wire is lifted up from the lower wire.

19 Claims, 5 Drawing Sheets

U.S. PATENT DOCUMENTS

| | | | | |
|---|---|---|---|---|
| 4,875,977 | * | 10/1989 | Crzagan et al. | 162/301 |
| 4,885,088 | * | 12/1989 | Sbaschnigg | 162/301 |
| 5,045,153 | | 9/1991 | Sollinger et al. | 162/301 |
| 5,074,964 | | 12/1991 | Partanen | 162/203 |
| 5,427,654 | * | 6/1995 | Gray et al. | 162/301 |
| 5,554,267 | | 9/1996 | Grossman et al. | 162/301 |

* cited by examiner

TWIN-WIRE FORMER AND PROCESS FOR SEPARATING UPPER AND LOWER WIRES OF HTE TWIN-WIRE FORMER

CROSS-REFERENCE TO RELATED APPLICATIONS

The present application claims priority under 35 U.S.C. § 119 of German Patent Application No. 198 09 480.9, filed on Mar. 6, 1998, the disclosure of which is expressly incorporated by reference herein in its entirety.

BACKGROUND OF THE INVENTION

1. Field of the Invention

The present invention relates to a twin-wire former for producing a fibrous material web, e.g., a paper or cardboard web, from a fibrous suspension. The invention may also be related to further drainage of the fibrous material web. The present invention is based on a twin-wire former that includes two endless wire belts, e.g., a lower wire and upper wire, which jointly form a twin-wire zone. The upper wire is guided by at least two rolls, e.g., an inlet roll, which guides the upper wire to the twin-wire zone, and an outlet roll, which guides the upper wire back toward the inlet roll, and the upper and lower wires form a wedge-shaped inlet zone having an adjustable wedge angle. An upper wire subassembly, which includes a drainage box to receive suspension water flowing upwardly through the upper wire, as well as a common support device for the drainage box and for the inlet roll, is provided. The common support device can be pivoted via a stroke device around a horizontal "operational pivot" axle to vary the wedge angle during former operation.

2. Discussion of Background Information

Systems similar in general to the above-noted device have been discussed, e.g., in German Application No. 40 05 420, of which U.S. Pat. No. 5,045,153 is a patent family member; German Patent No. 43 26 867, of which U.S. Pat. No. 5,554,267 is a patent family member; and European Application No. 0 397 430, of which U.S. Pat. No. 5,074,964 is a patent family member.

The above noted documents, in contrast to the present invention, relate exclusively to so-called hybrid formers, in which a fibrous suspension flows onto the lower wire first. The web formation begins on the lower wire by removing water downwardly through the lower wire. Then the upper wire comes into contact with the remaining fibrous suspension in the twin-wire zone so that at this point, further web formation occurs via removing water upwardly through the upper wire, and, generally, downwardly through the lower wire. As a rule, the web formation is completed in the region of the twin-wire zone, i.e., there are no more free floating fibers, and, more often than not, from this point on, further drainage of the fibrous material web occurs to increase the dry matter content as much as possible.

In the twin-wire zone, it is possible, if necessary, to vary the inlet wedge angle (i.e., the angle of the wedge-shaped inlet zone) during operation so as to adapt the twin-wire former to various layer thicknesses of the incoming fibrous suspension. Sometimes, it is also desirable to move the point at which the upper wire comes into contact with the fibrous suspension, i.e., either in the web travel direction or in the opposite direction. To this end, it is known to pivot the upper wire subassembly with a stroke device around an operational pivot axle. In the known twin-wire formers, at least one additional (and costly) stroke device is provided to vertically adjust the position of the operational pivot axle. This adjustment via the additional stroke device is used for the purpose of lifting the upper wire subassembly up from the lower wire, e.g., to facilitate the changing of the wire and/or to prevent damage to the wires when there is an undesired stoppage of one of the two wires.

In the above-cited references, a number of different positions are provided for the operational pivot axle. According to a variant shown in FIG. 2 of European Application No. 0 397 430, the operational pivot axle is located in the vicinity of the point at which the wires emerge from the drainage box (which is positioned inside the loop of the upper wire). This arrangement, which may be utilized in the twin-wire former according to the present invention, is favorable because, with a change of the inlet wedge angle, there is no horizontal motion of any consequence for the strips of the drainage box (which touch the upper wire) relative to the drainage elements located inside the lower wire loop. Such relative motion would impair the proper formation of the fibrous web. Also, the outlet end of the drainage box is prevented from vertical motion of any consequence, which would impair the proper travel of the two wires to the subsequent wire-separating device.

SUMMARY OF THE INVENTION

The present invention reduces the structural expenditure for the adjustment of the upper wire subassembly as compared to known twin-wire formers.

The instant twin-wire former of the present invention provides several desired features for a twin-wire former, e.g., a variable inlet wedge angle; and an upper wire subassembly which can be lifted up from the lower wire to prevent contact between the wires. The twin-wire former of the present invention is structured such that, as the inlet wedge angle is varied, horizontal movements of any consequence by the drainage box, which is located within the loop of the upper wire, and vertical movement of the outlet end of the drainage box, with the exception of negligible movement, are prevented.

The present invention provides a twin-wire former in which the stroke device, which is coupled to the common support device, is the sole stroke device. Thus, according to the present invention, the single stroke device is utilized to vary the wedge angle and to lift the upper wire subassembly up from the lower wire. Moreover, the upper wire subassembly is associated with an additional or second horizontal pivot axle located in a region of the outlet roll, so as to lift the upper wire subassembly up from the lower wire. An advantageous feature of the present invention is that the second pivot axle, which is located in the vicinity of the outlet roll, is also located in the vicinity of the point at which the wires emerge from the drainage box. In this manner, the upper wire subassembly may be pivoted upwardly and around the second pivot axle via the sole stroke device, which is preferably located in the vicinity of the inlet roll, to lift the upper wire subassembly up from the lower wire, thereby producing a gap between the two wires. According to the arrangement of the present invention, the second pivot axle is only effective after a maximal possible increase of the inlet wedge angle has taken place. By eliminating the necessity of an additional stroke device and the associated control therefore, considerable cost savings and simpler operability of the twin-wire former may be provided.

Further, another simplification is conceivable when only a single pivot axle is provided for the upper wire subassembly, and the single pivot axle is located in the region between the drainage box and the outlet roll. The upper wire subassembly may move around the single pivot axle, particularly when the inlet wedge angle is being changed. Moreover, if it is desired to reliably produce a gap between the two wires by even further lifting the upper wire subassembly, then the pivot axle may be preferably positioned in the region between the suction separator and the outlet roll. However, during inlet wedge angle changes with this arrangement, the outlet end of the drainage box may move slightly in the vertical direction.

Accordingly, the present invention is directed to a twin-wire former for producing a fibrous material web from a fibrous suspension that includes a twin-wire zone composed of a lower wire and an upper wire and a plurality of rolls including an inlet roll and an outlet roll. The upper wire is guidable over the plurality of rolls, the inlet roll is adapted to guide the upper wire to the twin-wire zone, and the outlet roll is adapted to guide the upper wire toward the inlet roll. A wedge-shaped inlet zone to the twin-wire zone is formed between the upper wire and the lower wire and has an adjustable inlet wedge angle. An upper wire subassembly includes a drainage box adapted to receive suspension water that flows upwardly through the upper wire, and further includes a pivotable common support device, to which the drainage box and the inlet roll are mounted. A stroke device is coupled to the pivotable common support device to lift the pivotable common support device around a first horizontal axle. In this manner, the inlet wedge angle is varied during former operation. After a maximal inlet wedge angle is formed, continued lifting of the pivotable common support device by the stroke device causes the upper wire subassembly to lift up from the lower wire, thereby separating the upper wire from the lower wire. A second horizontal pivot axle associated with the upper wire subassembly and located in a region of the outlet roll is provided. The separating of the upper and lower wires occurs around the second horizontal pivot axle.

In accordance with another feature of the present invention, the second horizontal pivot axle becomes operational after an increase of the inlet wedge angle.

In accordance with another feature of the present invention, during former operation, the common support device is disengaged from the second horizontal pivot axle.

In accordance with still another feature of the present invention, when the stroke device lifts the upper wire subassembly from the lower wire, the common support device disengages from the first horizontal axle.

In accordance with still another feature of the present invention, a suction separator may be located at an end of the twin-wire zone and inside a loop of the lower wire. Further, a wire travel plane over the suction separator may be convexly curved. Still further, the suction separator may be coupled to the upper wire subassembly.

In accordance with a further feature of the present invention, the common support device may be composed of a pivotable inlet section and a pivotable outlet section, which are coupled to each other by an articulated joint. The first horizontal axle may be movable parallel to a wire travel direction. During former operation, the pivotable inlet section may be supported by the first horizontal axle, and the pivotable outlet section may be continuously supported by the second horizontal pivot axle. A closable gap may be located between the pivotable inlet section and pivotable outlet section, and a stop device, which limits a closure of the closable gap and which is engagable when the inlet wedge angle has been maximally increased, may be coupled to the common support device. After engagement of the stop device, further lifting disengages the pivotable inlet section from the first horizontal axle. Further, the articulated joint is positioned at least in a vicinity of an angle bisector between travel paths of the upper wire around the outlet roll.

In accordance with a still further feature of the present invention, the support device is composed of a pivotable inlet section and a rigid outlet section, which are coupled to each other by brackets adapted to rest on rigid supports during former operation. The pivotable inlet section may be pivotably supported by the brackets around the first horizontal axle, and the first horizontal axle may be mounted for movement between stops on the bracket. The brackets may be pivotably supported in the rigid outlet section by the second horizontal pivot axle. After the maximal increase of the inlet wedge angle, the first horizontal axle contacts one of the stops on the bracket, such that the pivotable inlet section becomes rigidly coupled to the brackets by a stop. Further lifting of the upper wire subassembly is pivoted around the second pivot axle.

In accordance with another feature of the present invention, the first horizontal axle may be located in a vicinity of a point at which the upper and lower wires emerge from the drainage box.

In accordance with still another feature of the present invention, the drainage box may include a plurality of successively arranged strips, and the first horizontal axle may be located in a wire travel plane of a last strip of the drainage box.

In accordance with another feature of the present invention, carriages may be mounted for movement relative to a machine frame. Further, the movement of the carriages is in at least one of parallel to and cross-wise to the web travel direction.

In accordance with a further feature of the present invention, the support device includes two longitudinal supports, and the drainage box may be mounted to couple the two longitudinal supports together.

In accordance with still another feature of the present invention, the fibrous material web is composed of one of a paper and a cardboard web.

In accordance with still another feature of the present invention, the plurality of rolls includes three rolls.

The present invention may be directed to a twin-wire former for producing a fibrous material web from a fibrous suspension that includes a twin-wire zone composed of a lower wire and an upper wire and a plurality of rolls including an inlet roll and an outlet roll. The upper wire is guidable over the plurality of rolls, the inlet roll is adapted to guide the upper wire to the twin-wire zone, and the outlet roll is adapted to guide the upper wire toward the inlet roll. A wedge-shaped inlet zone to the twin-wire zone is formed between the upper wire and the lower wire and has an adjustable inlet wedge angle. An upper wire subassembly includes a drainage box adapted to receive suspension water that flows upwardly through the upper wire, and further includes a pivotable common support device, to which the drainage box and the inlet roll are mounted. A stroke device is coupled to the pivotable common support device to lift the pivotable common support device around a first horizontal axle located in a region between the drainage box and the outlet roll. In this manner, the inlet wedge angle may be varied during former operation. After a maximal inlet wedge angle is formed, continued lifting of the pivotable common support device by the stroke device causes the upper wire subassembly to lift up from the lower wire, thereby separating the upper wire from the lower wire.

In accordance with another feature of the present invention, the upper wire subassembly, when being lifted up from the lower wire, pivots about the first horizontal axle.

In accordance with a further feature of the present invention, the first horizontal axle may be located in a region between a suction separator and the outlet roll.

The present invention may also be directed to a process for lifting an upper wire from a lower wire in a twin-wire former. The twin-wire former includes a plurality of rolls comprising an inlet roll and an outlet roll. The upper wire is guidable over the plurality of rolls, the inlet roll guiding the upper wire to the twin-wire zone, and the outlet roll guiding the upper wire toward the inlet roll. A wedge-shaped inlet zone is formed between the upper wire and the lower wire and has an adjustable inlet wedge angle. An upper wire subassembly includes a drainage box, and further includes a pivotable common support device, to which the drainage box and the inlet roll are mounted. A stroke device is coupled to the pivotable common support device, a first horizontal axle is provided, and a second horizontal axle is located in a region of the outlet roll. The process includes lifting the common support device with the stroke device, such that the common support device is pivotably supported by the first horizontal axle and the inlet wedge angle is increased, and, upon maximally increasing the inlet wedge angle, further lifting the common support device with the stroke device, such that the common support device is pivotably supported by the second horizontal axle and is disengaged from the first horizontal axle. In this manner, the upper wire is lifted up from the lower wire.

In accordance with yet another feature of the present invention, the common support device is composed of an inlet support and an outlet support, which are coupled together by an articulated joint, and the lifting of the common upper device includes lifting the inlet support to form an angle between the inlet support and the outlet support less than 180°, whereby the inlet wedge angle is increased, and upon a maximal inlet wedge angle, stopping movement between the inlet support and the outlet support.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1A:
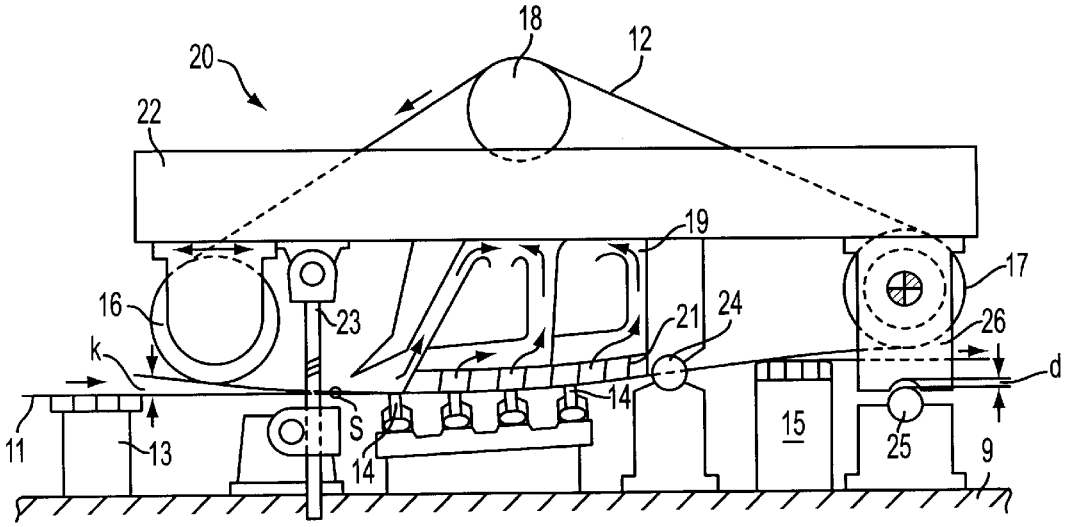
FIGS. 1A, 1B, and 1C illustrate different positions of an upper wire subsassembly in a first exemplary embodiment of the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

As illustrated in the Figures, a conventional long wire or lower wire 11 is shown essentially only in a region that forms a twin-wire zone with an upper wire 12. Lower wire 11 is guided around drainage elements, e.g., a suction box 13, forming strips 14, and a suction separator 15. Upper wire 12 may be guided by a plurality of, and, preferably, three, rolls 16, 17, and 18, which include an inlet roll 16 and outlet roll 17. Inlet roll 16 may be arranged to guide upper wire 12 to an adjustable wedge-shaped inlet zone of the twin-wire zone, which has an adjustable wedge angle k. Outlet roll 17 may be located in a region of the end of the twin-wire zone to guide upper wire 12 back toward inlet roll 16, e.g., via a regulating roll 18.

Rolls 16, 17, and 18 are components of an upper wire subassembly 20. Upper wire subassembly 20 may also include a drainage box 19 that has a plurality of strips 21 positioned on its underside arranged to touch upper wire 12 in a portion of the twin-wire zone in which forming strips 14 are elastically pressed, e.g., via pneumatic pressing elements, against lower wire 11. An underside of drainage box 19, which is formed by strips 21, may be flat or slightly convexly curved. Alternatively, the underside of drainage box 19 may include a flat region on the inlet side and a convexly curved region on the outlet side. Each of forming strips 14 may be positioned, e.g., opposite a gap between two of the strips 21 of drainage box 19.

A common support device 22, e.g., a frame composed of two longitudinal supports and lateral struts, may be provided for supporting rolls 16, 17, and 18 and drainage box 19. In lieu of lateral struts, drainage box 19 may be utilized to provide the lateral connection between the longitudinal supports. Common support device 22, and, consequently, the entire upper wire subassembly 20, may be supported on a machine frame 9 in a vicinity of inlet roll 16 by a stroke device 23, and, in a vicinity of a point at which wires 11 and 12 emerge from drainage box 19, by an articulated joint 24. Articulated joint 24 forms an operational pivot axle which extends horizontally, and cross-wise (laterally) to a web travel direction.

Beneath outlet roll 17, an additional pivot axle 25 is provided, which extends through the machine in a likewise horizontally cross-wise direction.

Figure 1B:
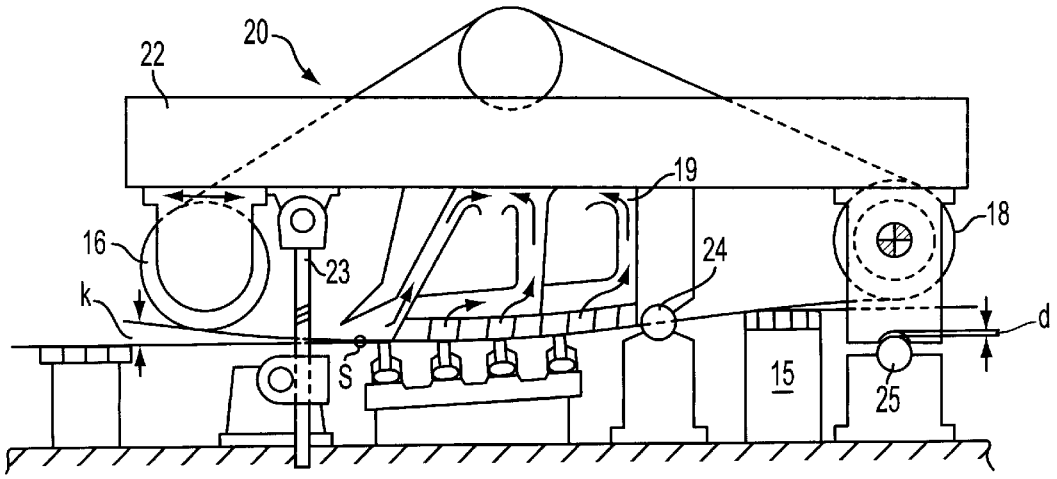

In FIGS. 1A and 1B, upper wire subassembly 20 is arranged in positions that are assumed during normal former operation. In FIG. 1A, inlet wedge angle k may be relatively small. In FIG. 1B, stroke device 23 has lifted upper wire subassembly 20 by a small amount, relative to the FIG. 1A arrangement, so that wedge angle k is greater than in FIG. 1A. As a result, the twin-wire former is adapted, e.g., to an increased layer thickness of the suspension arriving on the lower wire 11. Such a change of the position of upper wire subassembly 20 can also serve the purpose of shifting point S, at which upper wire 12 comes into contact with the suspension, in (or opposite to) the web travel direction.

Figure 1C:
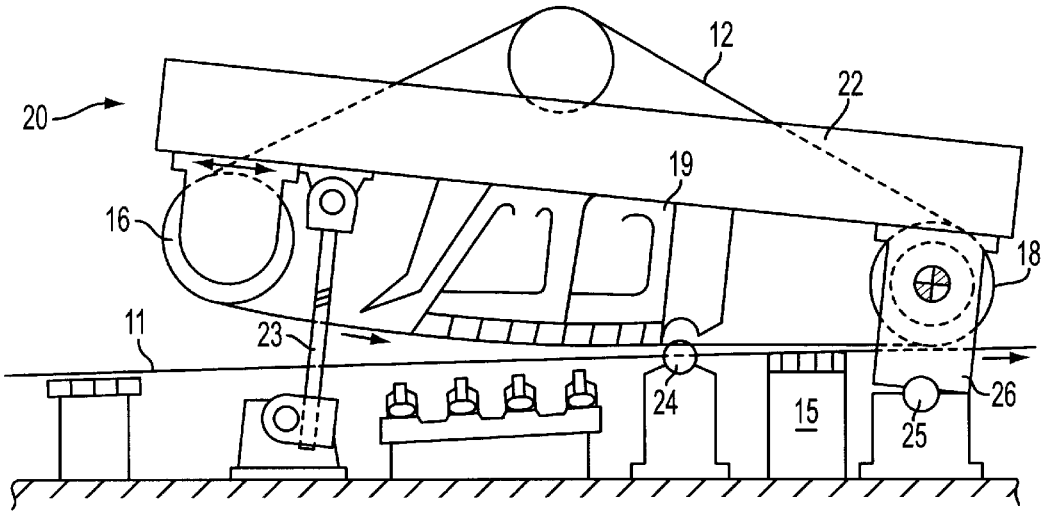

In both FIGS. 1A and 1B, bearing pedestals 26 of outlet roll 17 may be arranged to be disengaged from additional pivot axle 25 to form a distance d. FIG. 1C illustrates the situation when the user desires to lift upper wire subassembly 20 up from lower wire 11. In this regard, stroke device 23 is actuated to move upper wire subassembly 20 upwardly until bearing pedestals 26 come into engagement with additional pivot axle 25. As stroke device 23 continues to lift, upper wire subassembly 20 begins pivoting around additional pivot axle 25, and support device 22 may be lifted away from operational pivot axle 24. As is shown, wires 11 and 12 are thereby separated from each other.

Figure 2A:
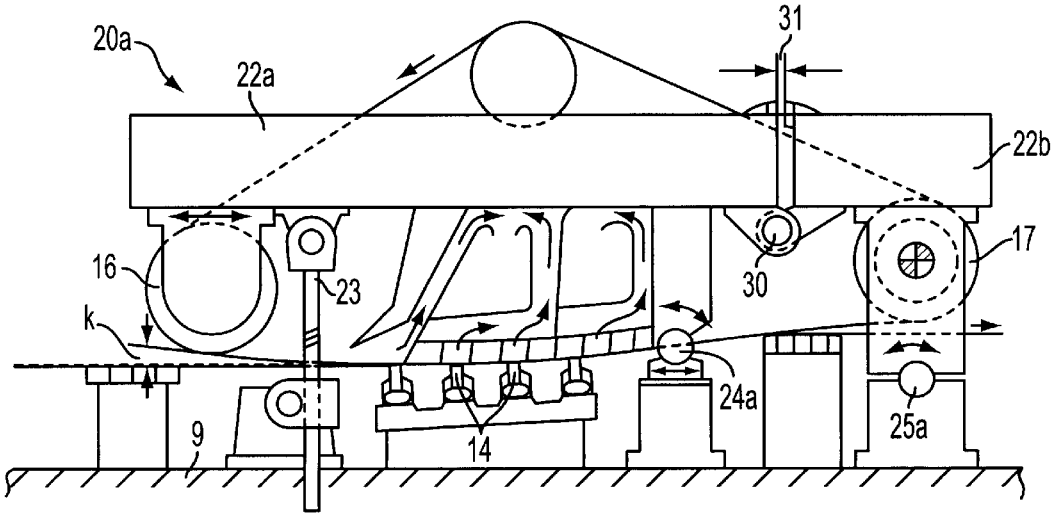
FIGS. 2A, 2B, and 2C illustrated different positions of an upper wire subassembly in another exemplary embodiment of the present invention.
Figure 2B:
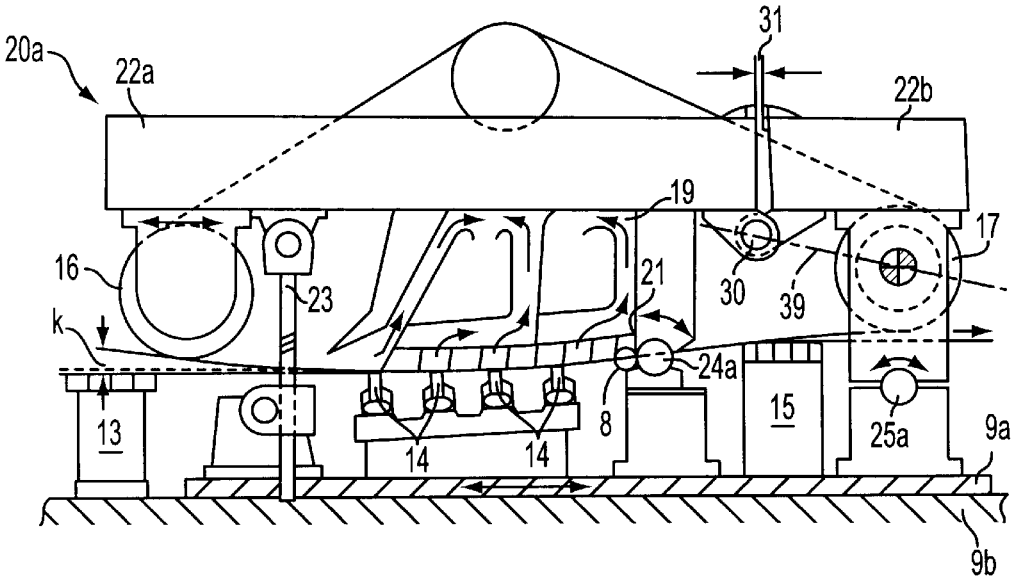
Figure 2C:
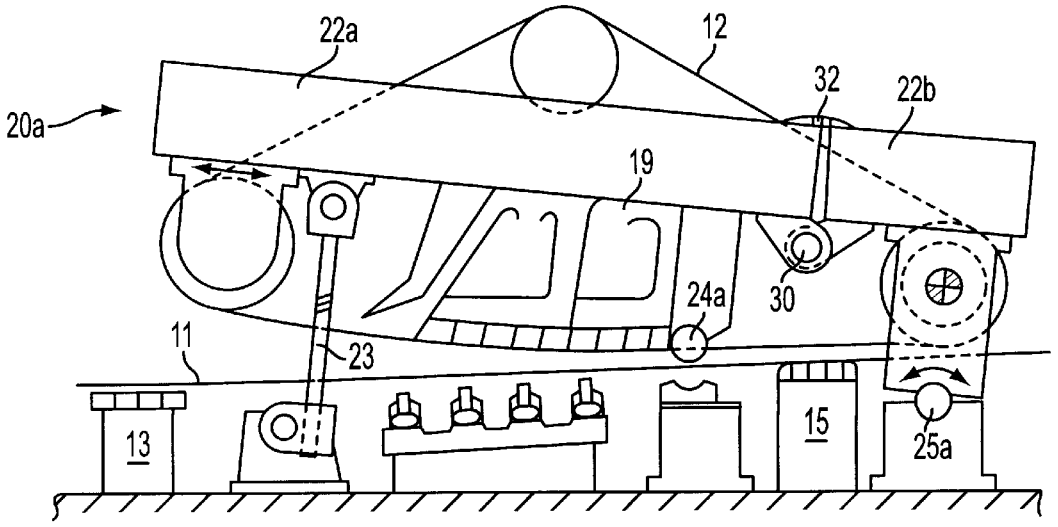

A quite similar effect can be achieved in accordance with the arrangement shown in FIGS. 2A–2C. As shown, common support device 20*a* may be divided into an inlet section 22*a* and an outlet section 22*b*. Inlet section 22*a* may be pivotably supported on an operational pivot axle 24*a*, which may be adjustably positionable in or against the web travel direction. Stroke device 23 may be located in the vicinity of inlet roll 16. Outlet section 22*b* may be supported on the additional or second stationary pivot axle 25*a*.

In contrast to the exemplary embodiment depicted in FIGS. 1A–1C, pivot axle 25*a* is continually operative. Inlet and outlet sections 22*a* and 22*b* of support device 20*a* may be coupled to each other through an articulated joint 30, and a gap 31 may be located in the region between inlet and outlet sections 22*a* and 22*b*. To adjust the angle of inlet wedge angle k, inlet section 22*a*, together with inlet roll 16 and drainage box 19, may be pivoted upwardly (or downwardly) around operational pivot axle 24*a*, whereby an angle between outlet section 22*b* and inlet section 22*a* is slightly adjusted as gap 31 changes in size due to movement of articulated joint 30 in a slightly downward (or upward) direction. Further, during a raising operation, operational pivot axle 24*a* may shift slightly in a direction counter to the web travel direction. Moreover, if it is desired, as illustrated in FIG. 2C, to further lift upper wire subassembly 20*a*, gap 31 may be closed or reduced to a value of zero. If desired, a pair of stop faces 32, e.g., may be provided for this purpose. Once gap 31 is closed, the entire upper wire subassembly 20*a* can be pivoted around additional pivot axle 25*a*, i.e., upper wire subassembly 20*a* is lifted away from, and no longer supported by, operational pivot axle 24*a*. In this way, wires 11 and 12 can in turn be released or separated from each other. To increase functional reliability, articulated joint 30 may be positioned such that a line 39 formed between articulated joint 30 and the rotational axis of outlet roll 17 bisects the travel path of upper wire 12 around outlet roll 17.

Figure 3:
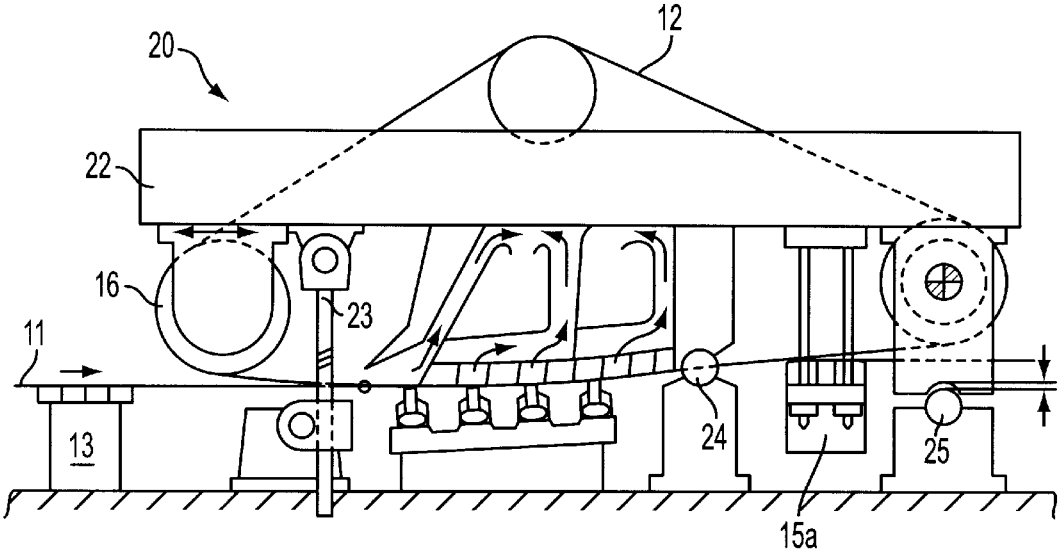
FIGS. 3, 4, and 5 illustrates other possible modifications of the twin-wire former according to the present invention.

The exemplary embodiment illustrated in FIG. 3 substantially corresponds to that of FIGS. 1A–1C, except that a suction separator 15*a* does not rest on machine frame 9. Instead, suction separator 15*a* may be suspended from common support device 22 of upper wire subassembly 20.

Figure 4:
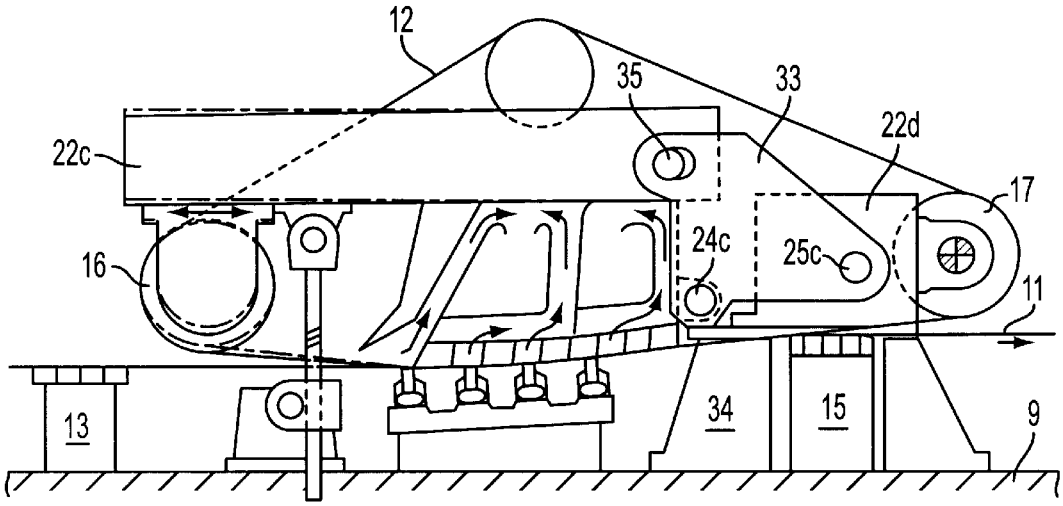

FIG. 4 illustrates another alternative exemplary embodiment, in which the common support device is divided into an inlet section 22*c*, which is pivotable, and an outlet section 22*d*, which is rigidly supported on machine frame 9. Inlet section 22*c* and outlet section 22*d* may be coupled to each other by brackets 33 that rest on rigid supports 34 during normal former operation. Inlet section 22*c*, to which inlet roll 16 and drainage box 19 may be coupled, may be supported on brackets 33 by operational pivot axle 24*c*. Further, brackets 33 may be supported by additional pivot axle 25*c* on rigid outlet section 22*d*, which also supports outlet roll 17. Pivotable inlet section 22*c* can be lifted in relation to brackets 33 only until a stop 35 is contacted. After this, inlet section 22*c* can be pivoted together with brackets 33 around additional pivot axle 25*c*, whereby upper wire subassembly is lifted up from lower wire 11.

Figure 5:
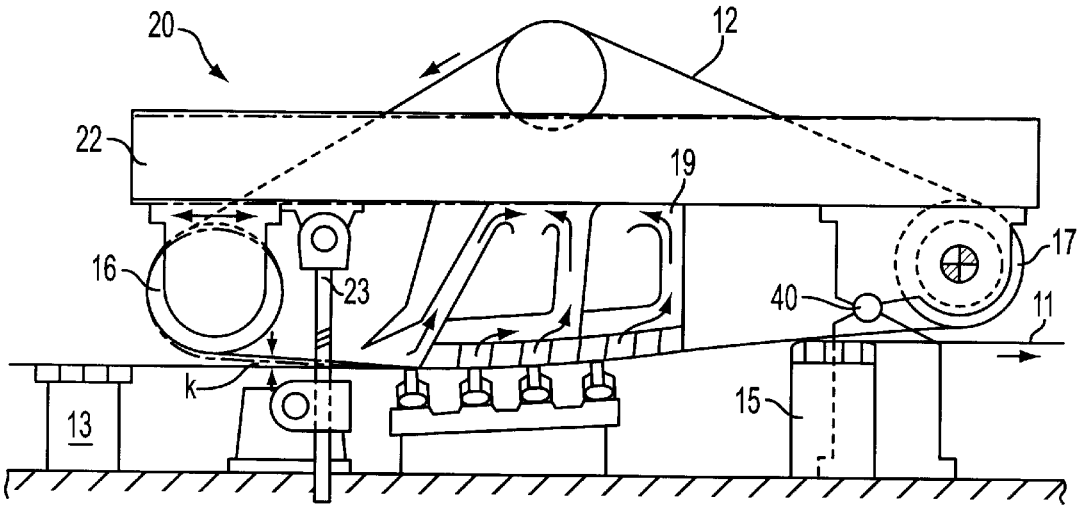

FIG. 5 illustrates another exemplary embodiment in which only a single pivot axle 40 is provided. Pivot axle 40 may be located in the region between drainage box 19 and outlet roll 17, and, preferably, between suction separator 15 and outlet roll 17.

Other possible embodiments in accordance with the features of the present invention are depicted in FIG. 2B. For example, it may be advantageous to position operational pivot axle 24 precisely in the wire travel plane of a last strip 21 of drainage box 19, as is symbolically depicted with numeral 8.

Likewise, it can be advantageous to position the entire twin-wire former, i.e., drainage elements 14 and 15 that are located inside the loop of lower wire 11, as well as the entire upper wire subassembly 20*a*, on carriages 9*a* that can be moved relative to the machine frame 9*b*, e.g., parallel to the web travel direction. In this manner, the entire twin-wire former can be brought into different positions relative to the other components of the long wire section (of which only suction box 13 can be seen). As a result, the web formation and drainage process can be adapted, e.g., to different types of paper or different processing speeds. It is also conceivable, via carriages 9*a*, for the entire twin-wire former to be movable by small distances cross-wise or lateral to the web travel direction, e.g., to prevent skating or streaking in the paper web. It is also possible to provide a shaking motion to the twin-wire former through at least one shaker.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A twin-wire former for producing a fibrous material web from a fibrous suspension, comprising:

a twin-wire zone composed of a lower wire and an upper wire;

a plurality of rolls comprising an inlet roll and an outlet roll;

the upper wire being guidable over the plurality of rolls, wherein the inlet roll is adapted to guide the upper wire to the twin-wire zone and the outlet roll is adapted to guide the upper wire toward the inlet roll;

a wedge-shaped inlet zone to the twin-wire zone being formed between the upper wire and the lower wire and having an adjustable inlet wedge angle;

an upper wire subassembly including a drainage box adapted to receive suspension water that flows upwardly through the upper wire, and further including a pivotable common support device, to which the drainage box and the inlet roll are mounted;

a stroke device coupled to the pivotable common support device to lift the pivotable common support device around a first horizontal axle, whereby the inlet wedge angle is varied during former operation, wherein, after a maximal inlet wedge angle is formed, continued lifting of the pivotable common support device by the stroke device causes the upper wire subassembly to lift up from the lower wire, thereby separating the upper wire from the lower wire; and a second horizontal pivot axle associated with the upper wire subassembly and located in a region of the outlet roll, wherein the separating of the upper and lower wires occurs around the second horizontal pivot axle.

2. The twin-wire former according to claim 1, wherein the second horizontal pivot axle is arranged to pivotably support the upper wire subassembly after the maximal increase of the inlet wedge angle.

3. The twin-wire former according to claim 2, wherein, during former operation, the common support device is structured and arranged to be disengaged from the second horizontal pivot axle.

4. The twin-wire former according to claim 1, wherein, when the stroke device lifts the upper wire subassembly from the lower wire, the common support device is structured and arranged to disengage from the first horizontal axle.

5. The twin-wire former according to claim 1, further comprising:

a suction separator located at an end of the twin-wire zone and inside a loop of the lower wire.

6. The twin-wire former according to claim 5, wherein a wire travel plane over the suction separator is convexly curved.

7. The twin-wire former according to claim 5, wherein the suction separator is coupled to the upper wire subassembly.

8. The twin-wire former according to claim 1, the common support device being composed of a pivotable inlet section and a pivotable outlet section, which are coupled to each other by an articulated joint;

the first horizontal axle being movable parallel to a wire travel direction, wherein, during former operation, the pivotable inlet section is supported by the first horizontal axle, and wherein the pivotable outlet section is continuously supported by the second horizontal pivot axle;

a closable gap located between the pivotable inlet section and pivotable outlet section; and a stop device, which limits a closure of the closable gap and which is structured to be engaged when the inlet wedge angle has been maximally increased, being coupled to the common support device, wherein after engagement of the stop device, further lifting disengages the pivotable inlet section from the first horizontal axle.

9. The twin-wire former according to claim 8, the articulated joint being positioned at least in a vicinity of an angle bisector between travel paths of the upper wire around the outlet roll.

10. The twin-wire former according to claim 1, the support device being composed of a pivotable inlet section and a rigid outlet section, which are coupled to each other by brackets adapted to rest on rigid supports during former operation;

the pivotable inlet section being pivotably supported by the brackets around the first horizontal axle, and the first horizontal axle being mounted for movement between stops on the bracket; and the brackets being pivotably supported in the rigid outlet section by the second horizontal pivot axle, wherein, after the maximal increase of the inlet wedge angle, the first horizontal axle contacts one of the stops on the bracket, whereby the pivotable inlet section becomes rigidly coupled to the brackets by a stop, wherein further lifting of the upper wire subassembly is pivoted around the second pivot axle.

11. The twin-wire former according to claim 1, the first horizontal axle being located in a vicinity of a point at which the upper and lower wires emerge from the drainage box.

12. The twin-wire former according to claim 1, the drainage box comprising a plurality of successively arranged strips; and the first horizontal axle is located in a wire travel plane of a last strip of the drainage box.

13. The twin-wire former according to claim 1, further comprising carriages which are mounted for movement relative to a machine frame.

14. The twin-wire former according to claim 13, wherein the movement of the carriages is in at least one of parallel to and cross-wise to the web travel direction.

15. The twin-wire former according to claim 1, the support device comprising two longitudinal supports; and the drainage box being mounted to couple the two longitudinal supports together.

16. The twin-wire former according to claim 1, the fibrous material web being composed of one of a paper and a cardboard web.

17. The twin-wire former according to claim 1, comprising three rolls.

18. A process for lifting an upper wire from a lower wire in a twin-wire former that includes a plurality of rolls comprising an inlet roll and an outlet roll, in which the upper wire is guidable over the plurality of rolls, the inlet roll guiding the upper wire to the twin-wire zone, and the outlet roll guiding the upper wire toward the inlet roll, a wedge-shaped inlet zone formed between the upper wire and the lower wire and having an adjustable inlet wedge angle, an upper wire subassembly including a drainage box, and further including a pivotable common support device, to which the drainage box and the inlet roll are mounted, a stroke device coupled to the pivotable common support device, a first horizontal axle, and a second horizontal axle located in a region of the outlet roll, the process comprising:

lifting the common support device with the stroke device, whereby the common support device is pivotably supported by the first horizontal axle and the inlet wedge angle is increased; and upon maximally increasing the inlet wedge angle, further lifting the common support device with the stroke device, whereby the common support device is pivotably supported by the second horizontal axle and is disengaged from the first horizontal axle, and whereby the upper wire is lifted up from the lower wire.

19. The process according to claim 18, wherein the common support device is composed of an inlet support and an outlet support, which are coupled together by an articulated joint, and the lifting of the common upper subassembly includes:

lifting the inlet support to form an angle between the inlet support and the outlet support less than 180°, whereby the inlet wedge angle is increased; and upon a maximal inlet wedge angle, stopping movement between the inlet support and the outlet support.

* * * * *